United States Patent [19]

Barbieri et al.

[11] 4,058,211

[45] Nov. 15, 1977

[54] ELECTRIC LAMP BULB PACKAGE AND SLEEVE COMPONENT THEREFROM

[75] Inventors: Thomas Barbieri, Peapack; Edward J. Getz, Irvington, both of N.J.

[73] Assignee: Westinghouse Electric Corporation, Pittsburgh, Pa.

[21] Appl. No.: 713,178

[22] Filed: Aug. 10, 1976

[51] Int. Cl.[2] ..... B65D 85/42; B65D 13/06

[52] U.S. Cl. ..... 206/422; 229/39 B; 229/9; 229/19

[58] Field of Search ..... 229/87 F, 23 BT, 9–11, 229/19–20, 39 B, 8; 206/418–422

[56] References Cited

U.S. PATENT DOCUMENTS

| | | | |
|---|---|---|---|
| 2,050,894 | 8/1936 | Paige | 229/8 |
| 2,940,653 | 6/1960 | Miessler, Sr. | 229/39 B |
| 3,069,008 | 12/1962 | Dugre | 229/39 B |

FOREIGN PATENT DOCUMENTS

| | | | |
|---|---|---|---|
| 185,903 | 10/1963 | Sweden | 229/19 |
| 1,064,544 | 4/1967 | United Kingdom | 206/418 |
| 110,271 | 10/1917 | United Kingdom | 229/11 |

*Primary Examiner*—William Price
*Assistant Examiner*—Douglas B. Farrow
*Attorney, Agent, or Firm*—D. S. Buleza

[57] ABSTRACT

One or more lamp bulbs are protectively packaged by inserting them into an open-ended wrapper of single-faced corrugated paperboard and slip-fitting the resulting lamp pack into an open-ended boxboard sleeve that overlies and closes the open ends of the wrapper. The sleeve has oppositely disposed corner portions with inwardly bowed flexible junctures of such curvature that they exert a wedging force on the associated end edges of the inscrted wrapper. The resulting clamping action frictionally locks the wrapper and the contained lamp bulbs within the boxboard sleeve despite the smooth surfaces of the latter.

10 Claims, 6 Drawing Figures

ELECTRIC LAMP BULB PACKAGE AND SLEEVE COMPONENT THEREFROM

BACKGROUND OF THE INVENTION

1. Field of the Invention

This invention relates to the packaging art and has particular reference to an improved package for fragile merchandise such as electric lamp bulbs, and to an improved sleeve component that is utilized in the package.

2. Description of the Prior Art

In the merchandising of fragile articles such as electric lamp bulbs that have glass envelopes which can be easily broken during shipment or subsequent handling at the retail level by store personnel or prospective customers, suitable packaging must be provided which will protect the merchandise from damage.

In the case of incandescent lamp bulbs of the type used in the home, the desired protection is generally obtained by placing one or more of the bulbs into a so-called wrapper of tubular open-ended construction that is fabricated from single-faced corrugated paperboard and is dimensioned to effect a snug fit with the bulbous-shaped portions of the lamp envelopes. The resulting lamp pack is of rectangular configuration and is inserted into an open-ended sleeve that is also of rectangular tubular configuration and fabricated from single-faced corrugated paperboard. The lamp pack is inserted into the sleeve in such a manner that the open ends of the wrapper are covered and closed by opposite walls of the sleeve. The sleeve is thus referred to as an "overwrap" in the art. The corrugated surface of the sleeve material constitute the inner wall surfaces of the sleeve and the interaction between the sleeve corrugations and engaged edges of the wrapper is relied upon to keep the wrapper and contained lamp bulbs within the sleeve. However, since the sleeve is rather flimsy, it does not positively or reliably "grip" the wrapper. As a result, the lamp pack frequently fell out of the sleeve. It was also difficult to imprint the uneven outer surfaces of the corrugated-paperboard sleeve with information regarding the lamp type, etc. The resulting package thus left much to be desired from the standpoint of strength, neatness and retention of the packed lamp bulbs.

A lamp bulb package which employs the prior art combination of a bulb wrapper and outer sleeve that are both fabricated from single-faced corrugated paperboard is disclosed in U.S. Pat. No. 2,654,472 issued Oct. 6, 1953 to R. T. White.

To overcome the aforementioned disadvantages and deficiencies, a modified lamp package has evolved in which the outer sleeve of single-faced corrugated paperboard is replaced by a sleeve that is fabricated from boxboard (that is, a stiff single-ply type of packaging material that is devoid of corrugations and thus has smooth even surfaces). While such boxboard sleeves are satisfactory from the standpoint of strength and printing neatness and clarity, the smooth inner surfaces of the sleeve are inherently incapable of frictionally "gripping" the edges of the inserted corrugated paperboard wrapper with sufficient tenacity to prevent the lamp pack from falling out of the sleeve while the package is being handled by clerks or prospective customers. Such incidents are not only irritating and embarrassing but are economically intolerable should the dislodged pack strike the counter or floor with sufficient force to break the glass envelopes or otherwise damage the packaged lamps.

It accordingly would be very desirable from an economical and merchandising standpoint to provide a lamp bulb package which utilizes an outer sleeve that is fabricated from boxboard material but is so constructed that it automatically locks the lamp pack within the sleeve in a positive and reliable manner and thus circumvents the "lamp drop-out" problem.

SUMMARY OF THE INVENTION

The foregoing objectives and advantages are achieved in accordance with the present invention by providing the boxboard sleeve with inwardly protruding means along opposite sides of the sleeve that exert a wedging force on the associated end edges of the lamp pack as it is being slip-fitted into the sleeve. In accordance with a preferred embodiment, the wedge-producing means comprise inwardly bowed hinge junctures that are located at diagonally opposite corner portions of the sleeve such junctures are formed by constructing the sleeve from a single piece of boxboard and providing it with curved fold lines that automatically cause the associated corner portions of the sleeve to bow inwardly toward each other when the sleeve is set up for use. The inwardly bowed corner portions of the sleeve thus constitute frictional-pressuring elements which force the engaged end edges of the corrugated paperboard wrapper to curl inwardly when the two units are assembled. The resulting interaction between the outer sleeve and inserted wrapper frictionally locks the wrapper and its contained lamp (or lamps) within the sleeve in a simple but very effective and practical manner.

BRIEF DESCRIPTION OF THE DRAWINGS

A better understanding of the invention will be obtained from the exemplary embodiments shown in the accompanying drawings, wherein.

DESCRIPTION OF THE PREFERRED EMBODIMENTS

While the present invention can be used in packaging various kinds of articles and merchandise that are fragile and of such a character that they might be destroyed or damaged if they accidentally fell out of the package, it is especially adapted for use in packaging electric lamp bulbs that have thin-walled glass envelopes which can be easily shattered.

Figure 1:
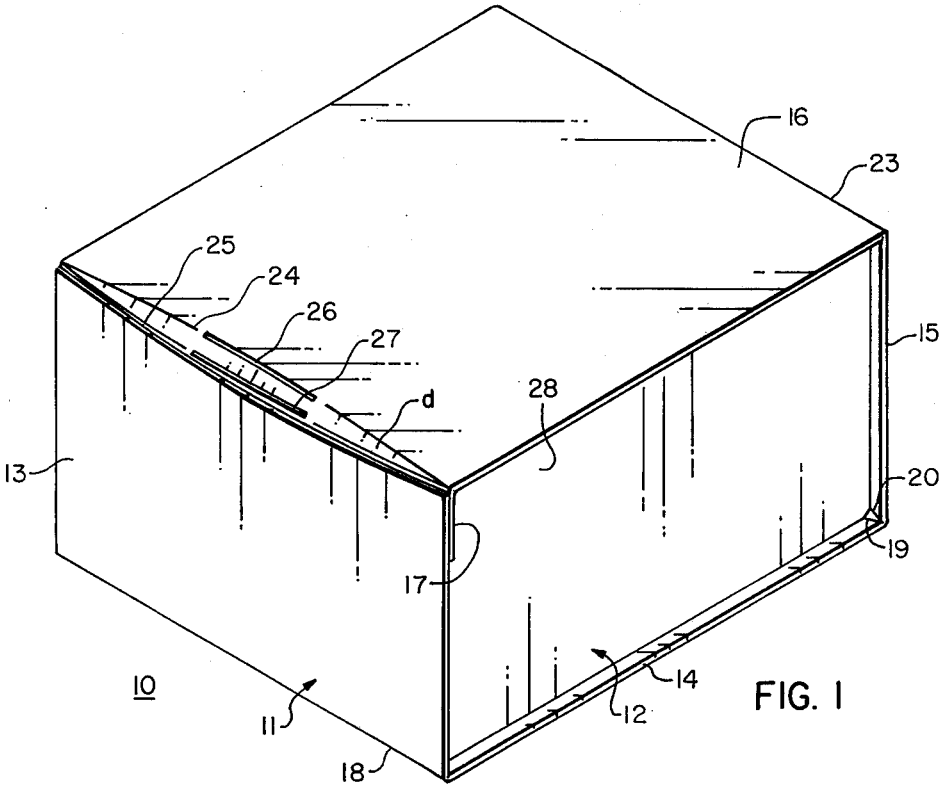
FIG. 1 is a pictorial view of an improved lamp bulb package which embodies the present invention.

A lamp bulb package 10 which incorporates the present invention is shown in FIG. 1. As will be noted, the package 10 is of rectangular shape and consists of two main parts or components — an outer sleeve 11 and a lamp pack 12 that is inserted into and is snugly enclosed by the sleeve.

Figure 2:
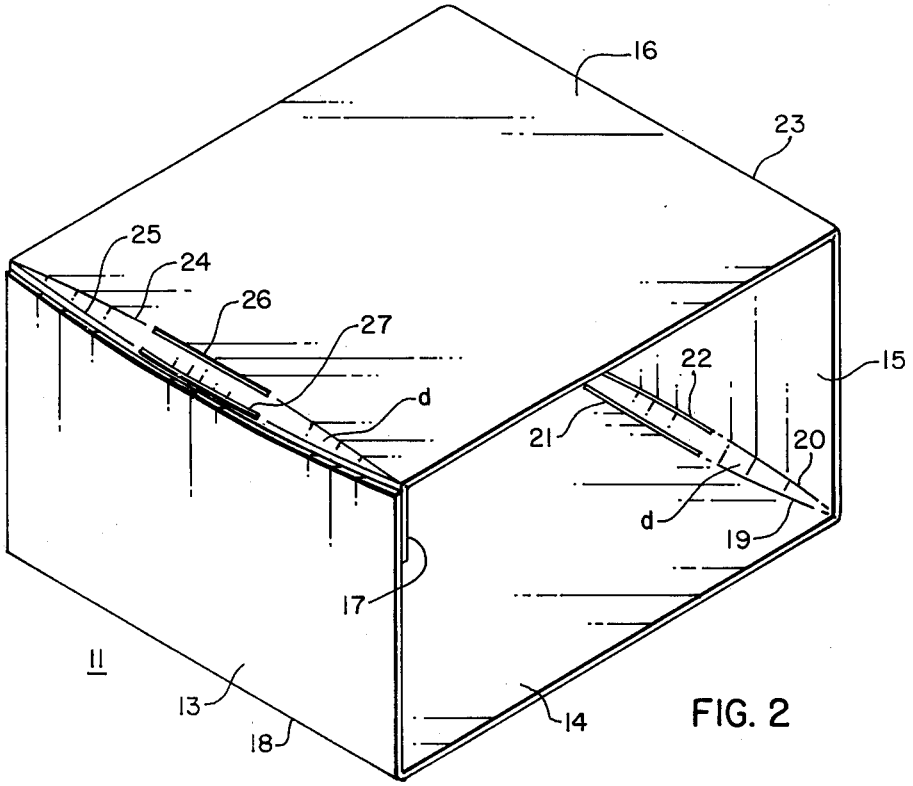
FIG. 2 is a similar view of the outer sleeve component of the package shown in FIG. 1.

As illustrated more clearly in FIG. 2, the "overwrap" or outer sleeve 11 is fabricated from stiff boxboard and has four walls 13, 14, 15 and 16 that are held in tubular configuration by means of a glue flap 17 that extends from wall 16 and is secured to the inner end surface of wall 13. The respective walls are hingedly interconnected by a series of spaced flexible junctures that are defined by a substantially straight score line 18 which extends between walls 13 and 14, a pair of arcuate cut-and-score lines 19 and 20 extend between walls 14 and 15, another substantially straight score line 23 that extends along walls 15 and 16, and a second pair of cut-and-score lines 24 and 25 that extend along wall 16 and the glue flap 17 (and thus constitute the juncture which joins wall 16 to wall 13).

The boxboard sleeve 11 is thus open at each end and is collapsible along the respective hinge junctures to facilitate bulk shipment of the sleeves from the box manufacturer to the lamp factory. When the sleeve 11 is set up or erected for use (as shown in FIG. 2), it is of rectangular configuration and the substantially straight score lines 18 and 23 are disposed at diagonally opposite corner portions and the paired arcuate cut-and-score lines 19–20 and 24–25 are located at the other diagonally opposed corner portions of the sleeve.

As will be noted, the individual cut-and-score lines in each pair of such lines are oriented so that they have opposite curvatures and diverge from one another with the apex of each line located at approximately the midpoint of the sleeve 11 along the direction in which the lamp pack 12 is inserted. To facilitate "setting-up" of the sleeve 11 from its "as-shipped" flat condition, the medial portions of each of the cut-and-score lines 19, 20, 24 and 25 are provided with slits 21, 22, 26 and 27, respectively, which insure that the sleeve 11 will "square up" and assume the rectangular tubular configuration required to receive the rectangular lamp pack 12. As will be noted in FIGS. 1 and 2, the end edge of wall 13 is terminated along an arcuate line that matches the curvature of the adjacent cut-and-score line 25 and slip 27 so as not to interfere with the "squaring up" operation.

The outer sleeve 11, pursuant to the invention, is thus provided with arcuate inwardly bowed junctures that are disposed on opposite sides of the sleeve — preferably, at diagonally opposite corner portions of the sleeve. These corner portions are accordingly prevented from assuming a true "right angle" configuration when the sleeve 11 is erected and protrude inwardly toward each other — thereby forming integral frictional-pressuring elements that interact with the inserted lamp pack 12 in such a manner that the latter is positively and securely locked within the sleeve, as hereinafter described.

Figure 3:
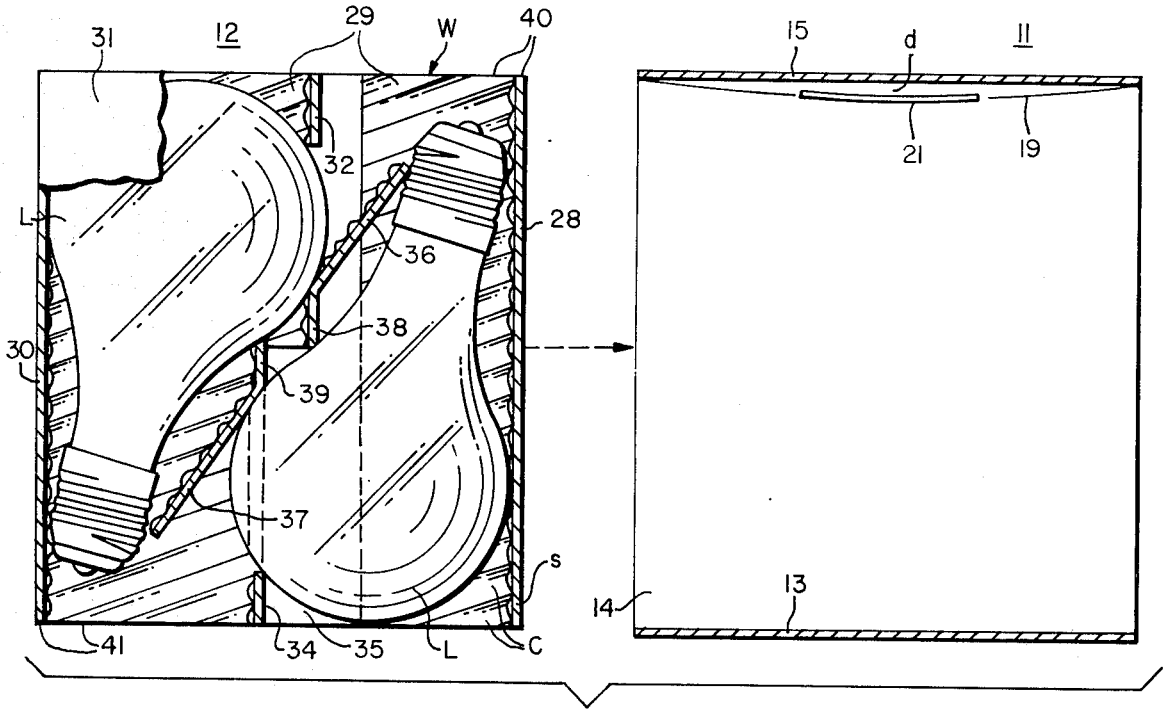
FIG. 3 is an exploded cross-sectional view of the lamp pack and sleeve components of the package illustrating the manner in which they are slip-fitted together and interlocked.

As shown in FIG. 3, the lamp pack 12 consists of a pair of electric lamp bulbs L that are arranged in nested relationship, with their constricted basal end portions pointed in opposite directions, and are held in such position by a suitable wrapper W that is fabricated from single-faced corrugated paperboard and is open at each end. As shown, the corrugated paperboard comprises a smooth facing sheet of paper "*s*" that is glued to a sheet of corrugated paper and the wrapper is so constructed that the corrugations "*c*" constitute the inner surface of the lamp wrapper W. The corrugations "*c*" are preferably offset or skewed relative to the transverse axis of the wrapper W in order to enhance the lamp-retention ability and compressive strength of the wrapper pursuant to the teachings of pending application Ser. No. 459,739 (now U.S. Pat. No. 4,007,836) entitled "Corrugated-Paperboard Wrapper for Packaging Electric Lamps, and Resulting Lamp Package," filed Apr. 10, 1974 by the present inventors and Robert J. Stauffer, which application is assigned to the assignee of this application.

As will be noted, the dual-lamp wrapper W is of rectangular configuration and has four walls 28, 29, 30 and 31. Only a portion of wall 31 is shown in order to illustrate the interior structure of the wrapper and orientation of the lamp bulbs L. While any conventional kind of lamp wrapper may be employed, the wrapper W illustrated is of a type that has a pair of offset partition panels 32 and 34 that are held in place by a depending flap 35 which is glued to the central portion of wall 29. Partition panel 32 is provided with a hinged flap 36 and partition panel 34 is provided with an identical flap 37. These flaps are displaced from their respective partition panels by the bulbous portions of the electric lamps L when the latter are inserted into the wrapper W, thus locking the lamps in place and providing upstanding spacer elements 38 and 39 which maintain a protective airspace between the fragile glass envelopes. The end edges 40 and 41 of the lamp wrapper W are substantially straight and the wrapper walls are so dimensioned that the open ends of the wrapper are terminated along planes that are substantially parallel to one another.

The width, length and height dimensions of the lamp pack 12 formed by the wrapper W and inserted lamp bulbs L relative to the corresponding dimensions of the outer sleeve 11 are such that the latter effects a snug fit with the lamp pack when the latter is slip-fitted into the sleeve, in the manner indicated in FIG. 3. When the lamp pack 12 is in its fully inserted position, walls 13 and 15 of sleeve 11 overlie and close the open ends of the wrapper W, thus forming the completely closed lamp package 10 shown in FIG. 1.

As will be noted in FIG. 3, the arcuate hinge-juncture provided by the paired cut-and-score lines 19-20 and slits 21-22 located along the corner portion of the sleeve 11 formed by walls 14 and 15 creates a curved inwardly-protruding deformation "I" which engages the associated end edge of the wrapper W (as the lamp pack 12 is being inserted). This deformation automatically curls the edge of the wrapper inwardly and effects a wedging or "pressuring" action that is at a maximum when the lamp pack 12 reaches its fully inserted position. The curling of the diagonally opposite end edge of the wrapper W effected by the other inwardly bowed juncture and deformation located at the associated corner portion of the sleeve 11 tightly wedges the inserted lamp pack 12 in the sleeve and positively and securely locks the two components together to form the desired lamp package 10.

Figure 4:
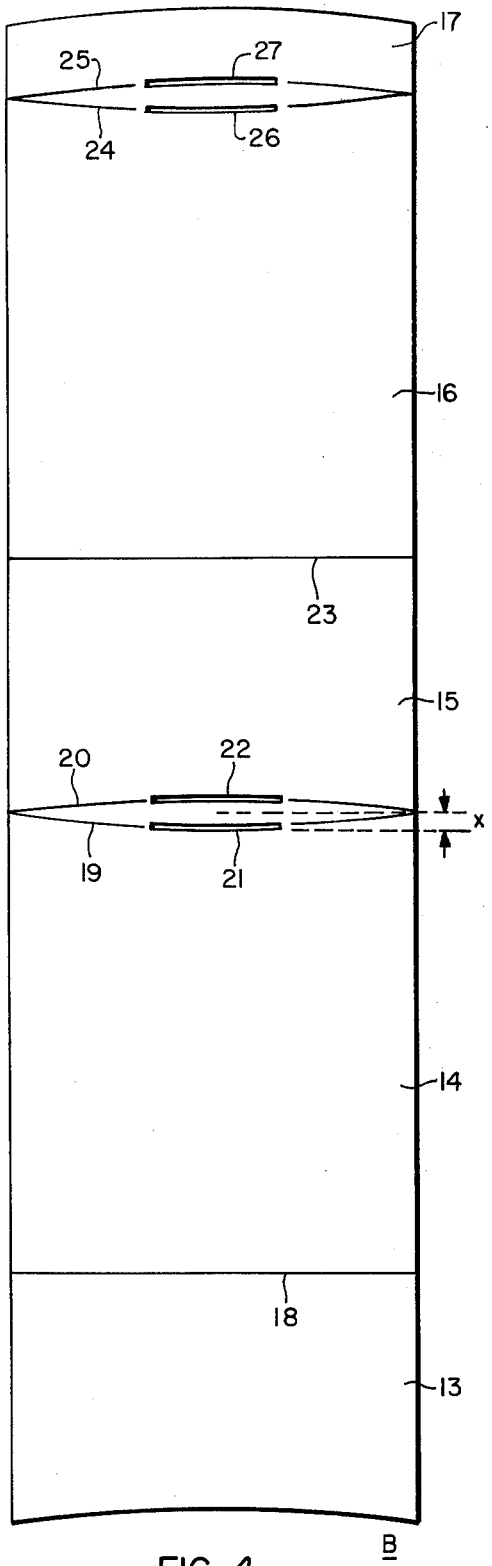
FIG. 4 is a plan view, on a reduced scale, of the blank from which the outer sleeve shown in FIGS. 1–3 is fabricated.

The outer sleeve 11 is preferably fabricated from a single piece of boxboard which is cut and scored to form a blank B of the type shown in FIG. 4. As will be noted, the blank is divided into four wall panels 13, 14, 15 and 16 and the glue flap 17 by the pair of substantially straight and parallel score lines 18 and 23 and the two sets of paired arcuate cut-and-score lines 19–20 and 24–25 and their paired arcuate slits 21–22 and 26–27, respectively. The side edge of wall panel 13 is of arcuate configuration and has a curvature which matches that of cut-and-score line 25.

The curvature of the bowed junctures required to reliably lock the inserted lamp pack 12 within the sleeve 11 is surprisingly quite small. In the case of a pair of 60 watt incandescent electric lamp bulbs of the configuration shown in FIG. 3, positive locking and reliable retention of the dual-lamp pack was achieved with a boxboard sleeve having bowed junctures of such curvature that the associated cut-and-score lines were each offset from a straight hinge line (which would normally be used) by a distance "*x*" (FIG. 4) of approximately 3.2 millimeters (⅛ of an inch). In contrast, the length dimension of wall panel 14 was approximately 114 millimeters (4½ inches), the corresponding dimension of wall panel 15 was approximately 63 millimeters (2½ inches), and the width of the blank B was about 102 millimeters (41/32 inches).

Figure 5:
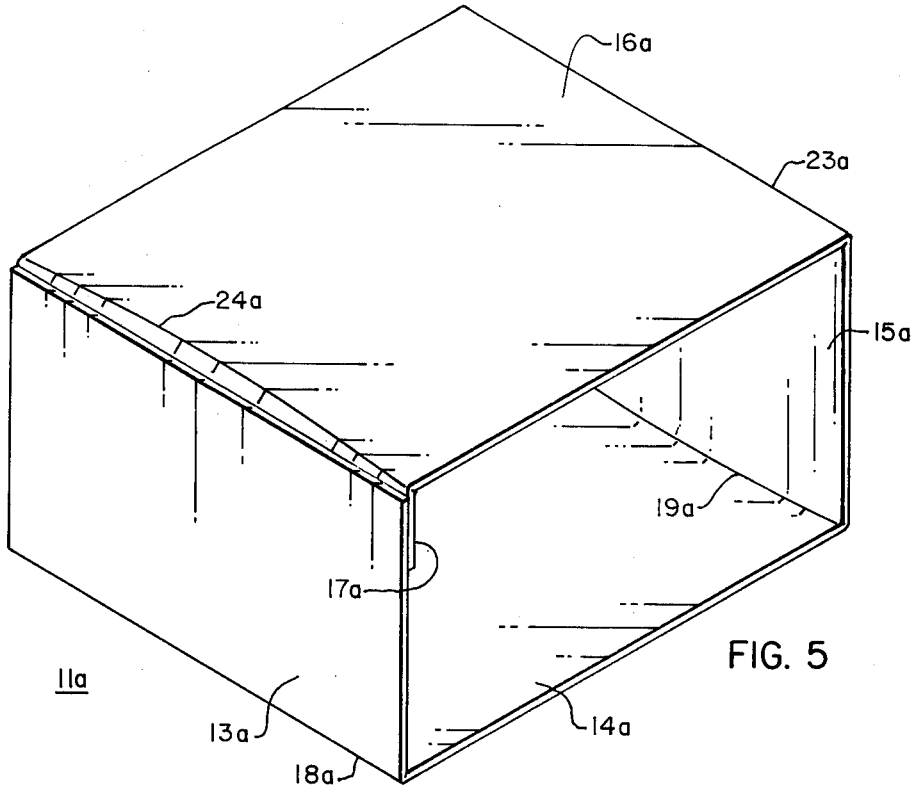
FIG. 5 is a pictorial view of an alternative sleeve embodiment.

The invention is not limited to a package having an outer sleeve which has selected flexible junctures that are made to bow inwardly by the above-described combinations of cut-and-score lines and slits but includes within its scope packages having outer sleeves with such bowed junctures that are defined by single score lines. An alternative sleeve embodiment 11*a* made in this fashion is illustrated in FIG. 5. As shown, the modified sleeve 11*a* is of the same open-ended rectangular construction as the previously described embodiment except that its walls 13*a*, 14*a*, 15*a* and 16*a*, and the glue flap 17*a* are hingedly connected along junctures that are defined by a pair of diagonally opposed score lines 18*a* and 23*a* that are substantially straight (as in the previous embodiment) and another set of diagonally opposed score lines 19*a* and 24*a* that are arcuate and bow inwardly. The pair of opposed curved score lines 19*a* and 24*a* effect the same automatic wedging action and inward curling of the engaged end edges of the single-faced corrugated paperboard wrapper as that obtained with sleeve embodiment 11. The only difference is that the use of single score lines of arcuate shape to provide the desired corner deformation and inwardly directed wedging forces makes it a little more difficult to erect the sleeve into "true" rectangular form from its collapsed condition.

Figure 6:
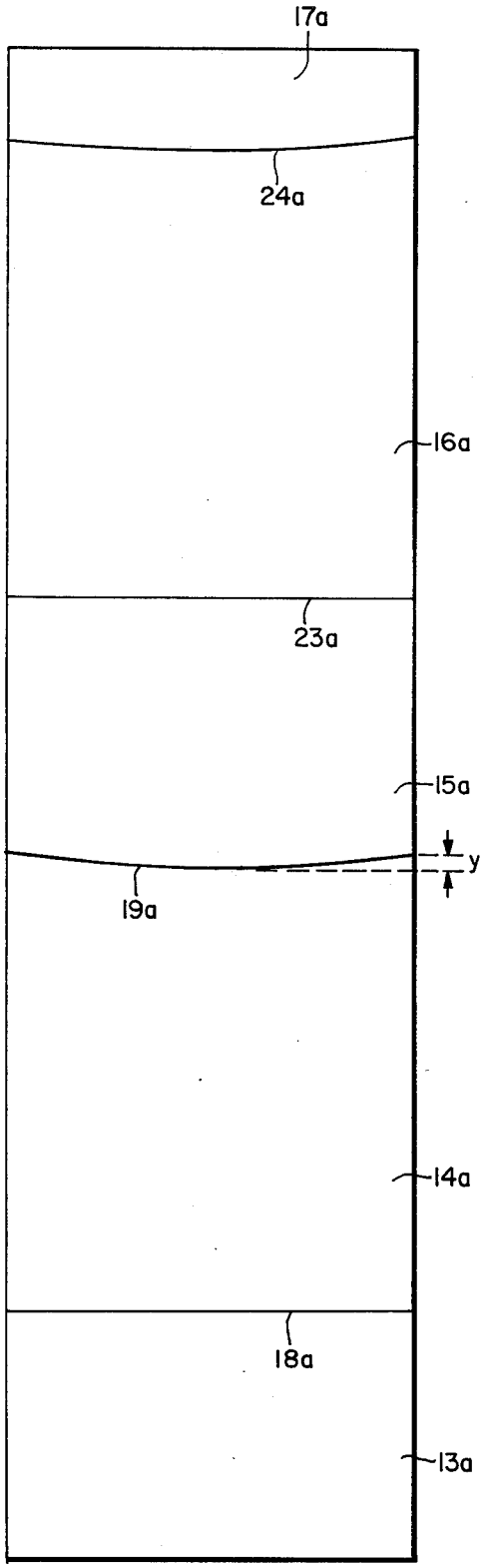
FIG. 6 is a plan view of the blank from which the alternative sleeve embodiment is fabricated.

The unitary blank Ba from which the alternative sleeve 11*a* is fabricated is shown in FIG. 6. As illustrated, the single piece of boxboard material is divided into wall panels 13*a*, 14*a*, 15*a* and 16*a* and the glue panel 17*a* by a substantially straight score line 18*a*, an arcuate score line 19*a*, another substantially straight score line 23*a*, and another arcuate score line 24*a*, respectively. As will be noted, the arcuate score lines 19*a* and 24*a* are curved in the same direction and to the same degree. The offset (dimension "Y") of the arcuate score lines from a straight score line (which would be normally used) is smaller than that employed in the previous embodiment. The offset is approximately 1.6 millimeters (about 1/32 of an inch) in the case of a sleeve designed for use in packaging a pair of 60 watt incandescent lamp bulbs.

While the invention has been illustrated in the form of a lamp package that contains a pair of lamp bulbs, it is not limited to this particular type of fragile article or to this particular number of articles. As will be obvious to those skilled in the art, the dimensions of the boxboard sleeve can be readily altered to receive and effect a positive frictional interlock with a corrugated wrapper that contains a single lamp or article, a suitably partitioned wrapper that contains more than two lamps or articles, and even two or more separate packs that contain one or several articles.

Since the same positive gripping and interlocking action by the inwardly bowed corners of the sleeve will be obtained with wrappers that are made of boxboard or other single-ply packaging material, the invention also encompasses packages having wrapper components that are fabricated from such materials.

We claim as our invention:

1. A package comprising;

a wrapper that is of tubular configuration and open at each end and includes a plurality of interconnected walls having end edges that are substantially straight and so arranged that the open ends of the wrapper are terminated along planes that are substantially parallel to one another, fragile merchandise disposed within said wrapper, and an open-ended sleeve that is fabricated from stiff single-ply packaging material that is devoid of corrugations and is slip-fitted over said wrapper and is so oriented that oppositely disposed walls of the sleeve overlie and cover the open ends of the wrapper and thus retain the fragile merchandise within the resulting package, said sleeve having additional walls that are connected to each other and said oppositely disposed walls along a series of spaced junctures which provide the sleeve with a plurality of corner portions that are in frictional engagement with the associated end edges of the wrapper, at least two of said junctures which are located on opposite sides of the sleeve being of arcuate configuration and providing corner portions that are bowed inwardly and thus exert a wedging force on the engaged portions of the wrapper that retains the wrapper and the contained merchandise within the sleeve despite the smooth inner surfaces of the non-corrugated sleeve.

2. The package of claim 1 wherein;

said wrapper has four walls, is fabricated from single-faced corrugated paperboard, and is of elongated substantially rectangular configuration, said sleeve also has four walls and is of substantially rectangular configuration, and said arcuate junctures are located at diagonally opposite corner portions of the sleeve.

3. The package of claim 2 wherein;

said fragile merchandise comprises one or more electrical lamp bulbs, and each of said arcuate junctures is of such curvature that the apex thereof is located at substantially the midpoint of the sleeve along the direction in which the wrapper is inserted.

4. The package of claim 2 wherein the corrugations of said wrapper constitute the inner surfaces thereof and are offset relative to the transverse axis of the wrapper.

5. The package of claim 2 wherein;

said sleeve is fabricated from boxboard, said fragile merchandise comprises a plurality of electric lamp bulbs, and said wrapper includes means which maintain the lamp bulbs in spaced-apart relationship.

6. The electric lamp package of claim 5 wherein;

said wrapper contains a pair of lamp bulbs that have constricted basal end portions and are disposed in oppositely oriented nested relationship, and said spacing means comprises a partition panel that is located between said lamp bulbs.

7. The electric lamp package of claim 5 wherein;

the walls of said sleeve constitute parts of a single piece of boxboard, and said arcuate junctures are defined by score lines.

8. The electric lamp package of claim 5 wherein;

the walls of said sleeve constitute parts of a single piece of boxboard, and said arcuate junctures are defined by cut-and-score lines.

9. The electric lamp package of claim 8 wherein each of said arcuate junctures is defined by a pair of arcuate cut-and-score lines that are of divergent curvature and include slits that constitute the medial segments of the repective cut-and-score lines.

10. An overwrap component adapted for use in packaging fragile merchandise such as an electric lamp bulb or the like that is disposed within an open-ended wrapper which is adapted to be inserted into the overwrap component in a manner such that the overwrap component covers the open ends of the wrapper, said overwrap component comprising an open-ended sleeve that (a) is fabricated from stiff single-ply packaging material which is devoid of corrugations and (b) has at least four walls selected ones whereof are hingedly connected together along arcuate junctures that are located on opposite sides of the sleeve and provide longitudinally extending corner portions which bow inwardly and thus constitute integral frictional-locking elements adapted to wedgingly engage the edge portions of an inserted wrapper.

* * * * *